US007255627B2

(12) United States Patent
Bodnar et al.

(10) Patent No.: US 7,255,627 B2
(45) Date of Patent: Aug. 14, 2007

(54) GARMENT DEVICE CONVERTIBLE TO ONE OR MORE FACEMASKS

(75) Inventors: Elena N. Bodnar, Hinsdale, IL (US); Raphael C. Lee, Chicago, IL (US); Sandra Marijan, Chicago, IL (US)

(73) Assignee: Avocet Polymer Technologies, Inc., Plainfield, IL (US)

( * ) Notice: Subject to any disclaimer, the term of this patent is extended or adjusted under 35 U.S.C. 154(b) by 255 days.

(21) Appl. No.: 11/049,525

(22) Filed: Feb. 1, 2005

(65) Prior Publication Data

US 2005/0282467 A1 Dec. 22, 2005

Related U.S. Application Data

(60) Provisional application No. 60/580,586, filed on Jun. 16, 2004.

(51) Int. Cl.
*A41D 13/00* (2006.01)
*A41C 3/12* (2006.01)
*A41C 3/00* (2006.01)

(52) U.S. Cl. ..... 450/1; 2/4; 2/9; 128/206.19

(58) Field of Classification Search ..... 2/4, 2/9, 51, 46; 450/36–39, 54–58, 86, 88, 1; 128/206.19, 206.17, 206.12, 206.21
See application file for complete search history.

(56) References Cited

U.S. PATENT DOCUMENTS 2,706,816 A * 4/1955 Dozier ..... 450/36
3,373,447 A 3/1968 Kim (Continued)

FOREIGN PATENT DOCUMENTS

EP 928568 7/1999

(Continued)

OTHER PUBLICATIONS

"Future Soldiers Will Wear Nanomaterials", Research & Development, vol. 44, No. 4, 2002, p. 10, Cahners Business Information, a division of Reed Elsevier, Inc., Apr. 2002.

(Continued)

*Primary Examiner*—Gloria M. Hale
(74) *Attorney, Agent, or Firm*—Bell, Boyd & Lloyd, LLP

(57) ABSTRACT

A garment device convertible to one or more facemasks wherein the garment device has a plurality of detachable cup sections. Each of the cup sections has a filter device, an inner portion positionable adjacent to the inner area of the user's chest, and an outer portion positionable adjacent to the outer area of the user's chest. The garment device has at least one securing device detachably coupling the inner portions of the cup sections to one another, and the garment device has at least one other securing device attached to the outer portion of at least one of the cup sections. This other securing device is operable to: (a) detachably couple the outer portions of the cup regions to one another; and (b) for each one of the cup sections, attach the outer portion of said cup region to the inner portion of said cup region after said cup region is detached from the other cup region, thereby converting the garment device to a plurality of facemasks.

26 Claims, 7 Drawing Sheets

U.S. PATENT DOCUMENTS

| | | | | | |
|---|---|---|---|---|---|
| 3,449,766 | A | | 6/1969 | Garber et al. | |
| 3,826,266 | A | * | 7/1974 | Alpert | 450/11 |
| 4,185,332 | A | * | 1/1980 | Jahnig | 623/7 |
| 4,269,191 | A | * | 5/1981 | Evans | 450/64 |
| 4,272,851 | A | | 6/1981 | Goldstein | |
| 4,392,258 | A | | 7/1983 | O'Neill | |
| 4,411,269 | A | * | 10/1983 | Weintraub | 450/58 |
| 4,416,284 | A | * | 11/1983 | Fink, IV | 450/1 |
| 4,589,408 | A | | 5/1986 | Singer | |
| 4,593,417 | A | | 6/1986 | Brown, Jr. et al. | |
| 4,641,380 | A | | 2/1987 | Epstein | |
| 4,864,654 | A | | 9/1989 | Schriver et al. | |
| 4,969,457 | A | | 11/1990 | Hubbard et al. | |
| 5,035,006 | A | * | 7/1991 | Hetz et al. | 2/209.11 |
| 5,546,604 | A | | 8/1996 | Geller | |
| 5,596,985 | A | | 1/1997 | Collier | |
| 5,797,786 | A | * | 8/1998 | Smith et al. | 450/1 |
| 6,364,980 | B1 | | 4/2002 | Smith et al. | |
| 6,507,486 | B2 | | 1/2003 | Peterson, III | |
| 6,775,850 | B1 | | 8/2004 | Grilliot et al. | |
| 7,118,444 | B2 | * | 10/2006 | Newman | 450/58 |
| 2002/0002846 | A1 | | 1/2002 | Bertola | |
| 2002/0022434 | A1 | | 2/2002 | Plourde et al. | |
| 2002/0098775 | A1 | | 7/2002 | Avellanet | |
| 2004/0031490 | A1 | | 2/2004 | Haaga | |
| 2004/0055079 | A1 | | 3/2004 | Haaga | |

FOREIGN PATENT DOCUMENTS

| | | |
|---|---|---|
| EP | 1053692 | 11/2000 |
| EP | 1060678 | 12/2000 |
| EP | 1243188 | 9/2002 |
| WO | WO95/18553 | 7/1995 |
| WO | WO96/35400 | 11/1996 |
| WO | WO98/26683 | 6/1998 |
| WO | WO 00/01258 | 1/2000 |
| WO | WO 00/08960 | 2/2000 |
| WO | WO 00/76433 | 12/2000 |
| WO | WO 01/91591 | 12/2001 |
| WO | WO 02/32241 | 4/2002 |
| WO | WO 02/37992 | 5/2002 |
| WO | WO 03/032761 | 4/2003 |
| WO | WO 03/056956 | 7/2003 |
| WO | WO 03/084355 | 10/2003 |
| WO | WO 03/096780 | 11/2003 |
| WO | WO 2004/006755 | 1/2004 |
| WO | WO 2004/034828 | 4/2004 |

OTHER PUBLICATIONS

"Chemical Agent Protective Clothing Ensembles", Second International Conference on Safety and Protective Fabrics: A Technical Focus on Textile and Material Development for Personal Protection, Navy Clothing and Textile Res. Facility—Natick, Apr. 26-28, 2000.

* cited by examiner

GARMENT DEVICE CONVERTIBLE TO ONE OR MORE FACEMASKS

PRIORITY CLAIM

This patent application is a non-provisional application of, and claims priority to and the benefit of, U.S. Provisional Patent Application Ser. No. 60/580,586, filed on Jun. 16, 2004, the entire contents of which are incorporated herein.

BACKGROUND OF THE INVENTION

As a result of biological or chemical warfare, poison-based weaponry, pollution or other environmental circumstances, the air people breathe can become contaminated with harmful substances. Nuclear accidents can cause the release of radioactive aerosols, such as iodine aerosols. The air may become contaminated with other aerosols or suspended radioactive particles, such as in a radiological attack, through the release of a radiological dispersion device (RDD) or due to so-called "dirty bombs." These damaging substances may include radioactive particles, germs, poisons, chemicals, dust, fluids, soot, smoke or other harmful airborne particles.

Certain individuals, such as soldiers, military personnel, firefighters, physicians and painters, have a higher risk of inhaling contaminated air. These individuals typically use facemasks to help protect themselves.

If a country or a territory is facing an on-going threat of air contamination, there is a need for these individuals as well as regular civilians to have a higher degree of access to facemasks. However, it is often inconvenient, impractical or burdensome for people to carry masks wherever they go.

Therefore, there is a need to overcome these disadvantages to help protect the health of civilians and non-civilians in the wake of air contamination.

SUMMARY OF THE INVENTION

The present invention relates to a garment device which converts into one or more facemasks. In one embodiment, the garment device is a bra or a brassiere garment. The bra has two cups. Each of the cups has a filter, an inner portion positionable adjacent to the inner area of the user's chest, and an outer portion positionable adjacent to the outer area of the user's chest. The inner portions of the cups are disconnectable, and the outer portions of the cups are disconnectable. As such, the bra is separable into two halves. Each halve is securable to a user's face to form a facemask.

In one embodiment, the bra includes two cups which include filter material, a back strap and a shoulder strap extending from each cup. The bra has a fastener on the front side of the bra in-between the cups and a fastener on the backside of the bra in between the back straps. The fasteners close in the front and the back to form a bra. When the garment is used as a bra, the cup portions are fitted over the breasts and the straps wrap around the torso to secure the bra to the body. When both of the fasteners are released, the garment device converts into two facemasks, each facemask including a cup and the straps. The user of the facemask places the cup or the mask chamber over the mouth-nose region or mouth-nose-chin region and wraps the straps around his or her head. The user can then use the facemask to help purify the inhaled air while keeping his or her hands free. Furthermore, the user can provide the other facemask to a bystander.

It is therefore an advantage of the present invention to provide a garment which is operable to be converted into a facemask.

Another advantage of the present invention is to provide a garment which is operable to be converted into a plurality of facemasks.

Yet another advantage of the present invention is to increase accessibility to facemasks.

Additional features and advantages of the present invention are described in, and will be apparent from, the following Detailed Description of the Invention and the figures.

DETAILED DESCRIPTION OF THE INVENTION

Figure 1:
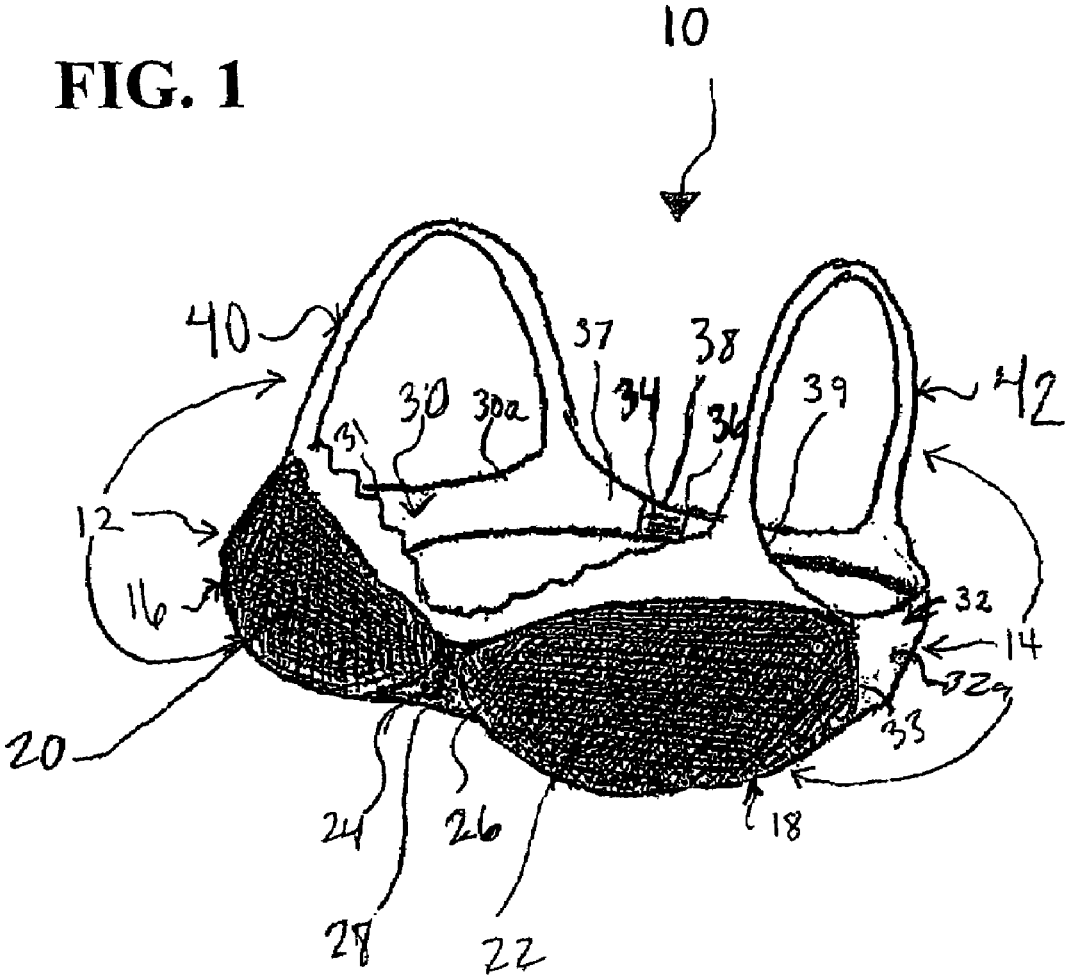
FIG. 1 is a front perspective view of the garment device of one embodiment of the present invention.
Figure 2:
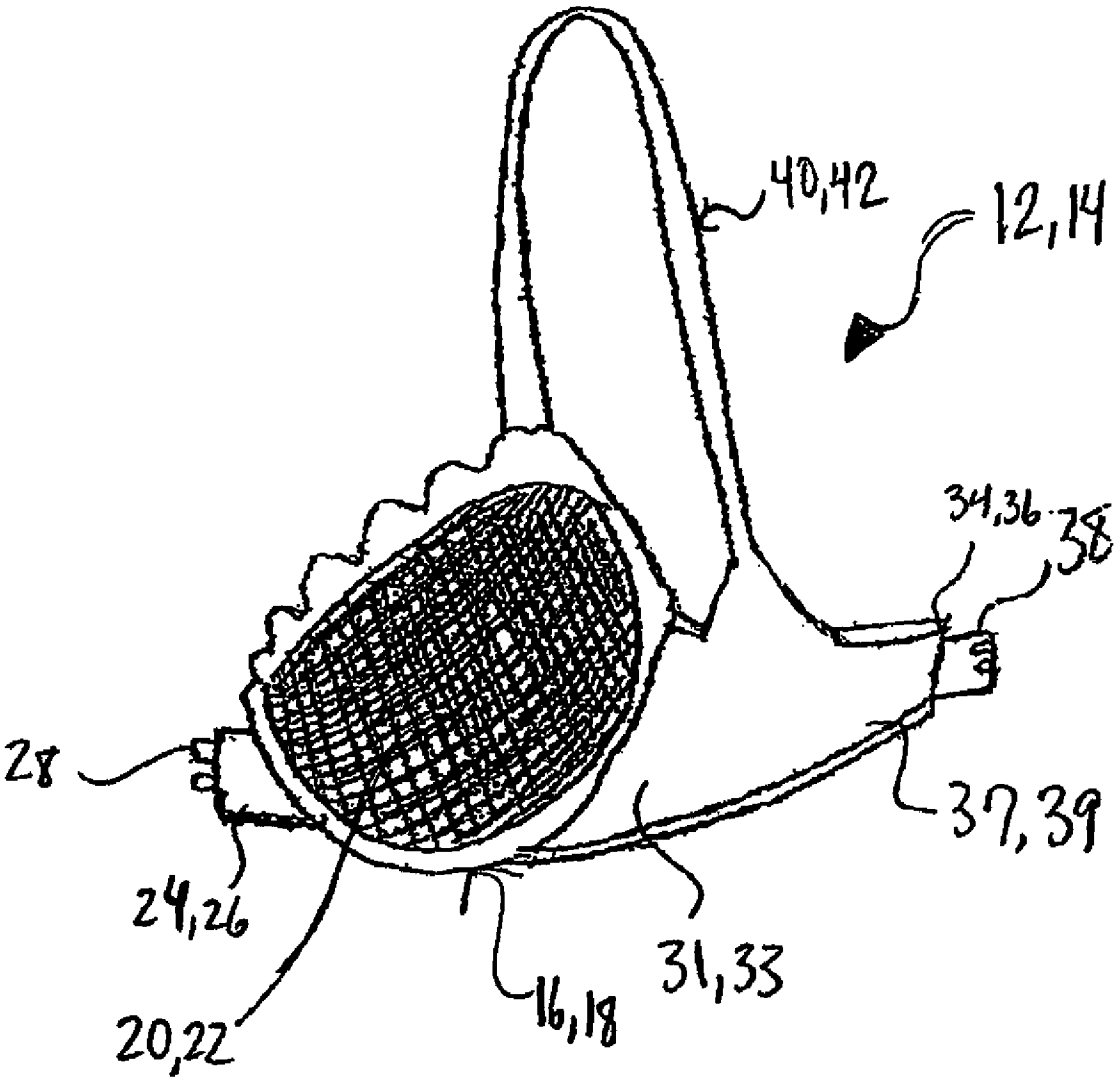
FIG. 2 is a side perspective view of the left chest garment region of one embodiment of the present invention, the right chest garment region being a mirror-image thereof.
Figure 3:
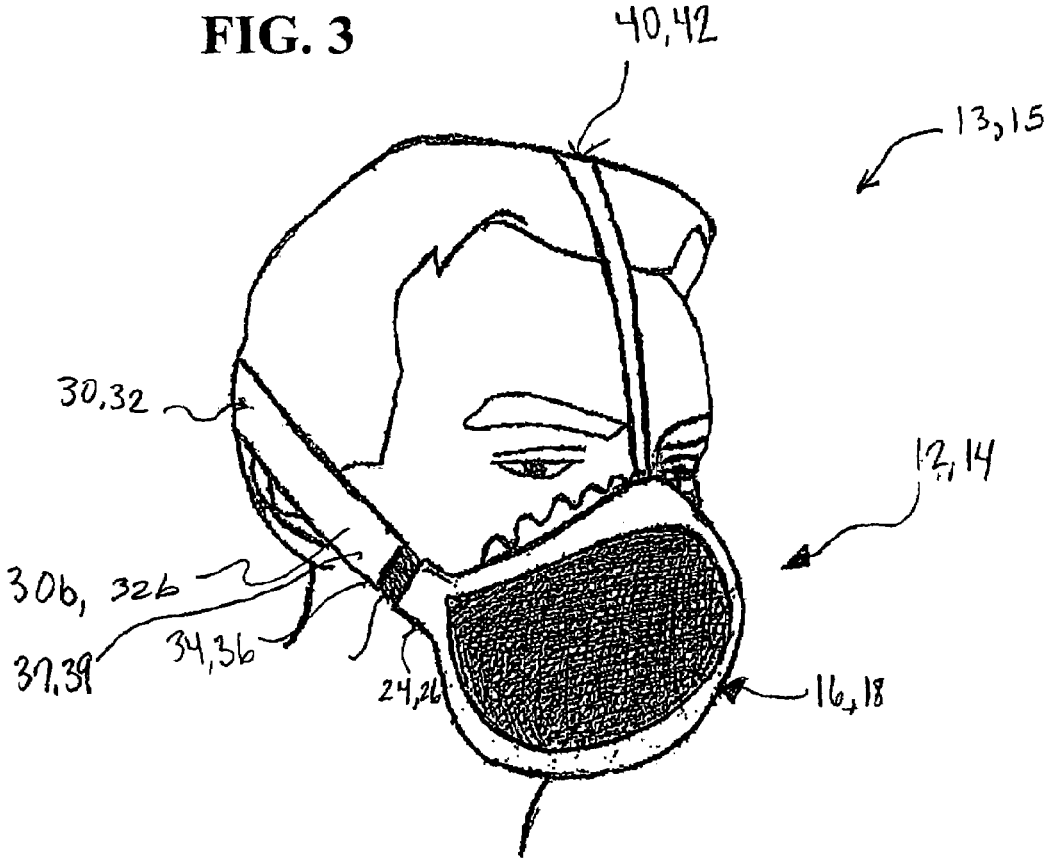
FIG. 3 is a front perspective view of the left chest garment region of FIG. 2 functioning as a facemask in one embodiment of the garment device of the present invention, the right chest garment region being a mirror-image thereof.
Figure 4:
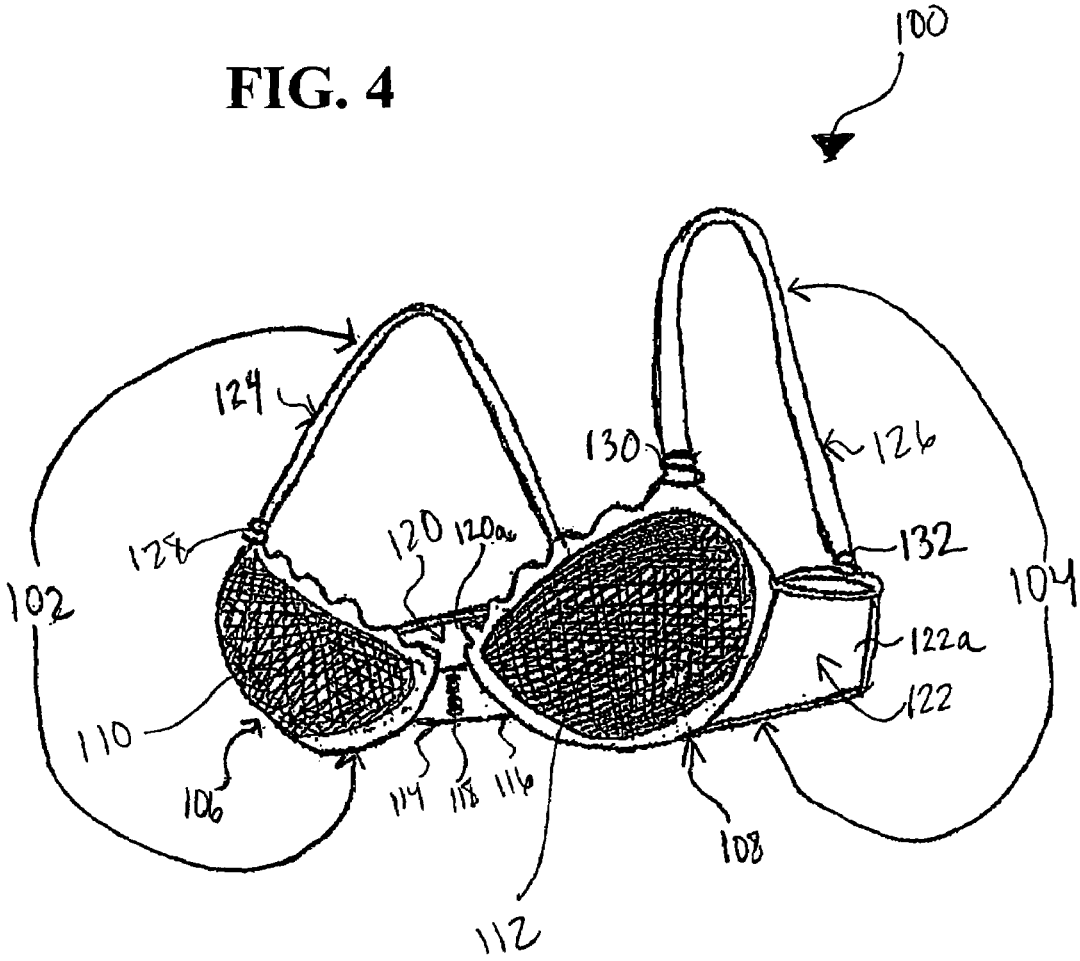
FIG. 4 is a front perspective view illustrating detachable arms of another embodiment of the garment device of the present invention.
Figure 5:
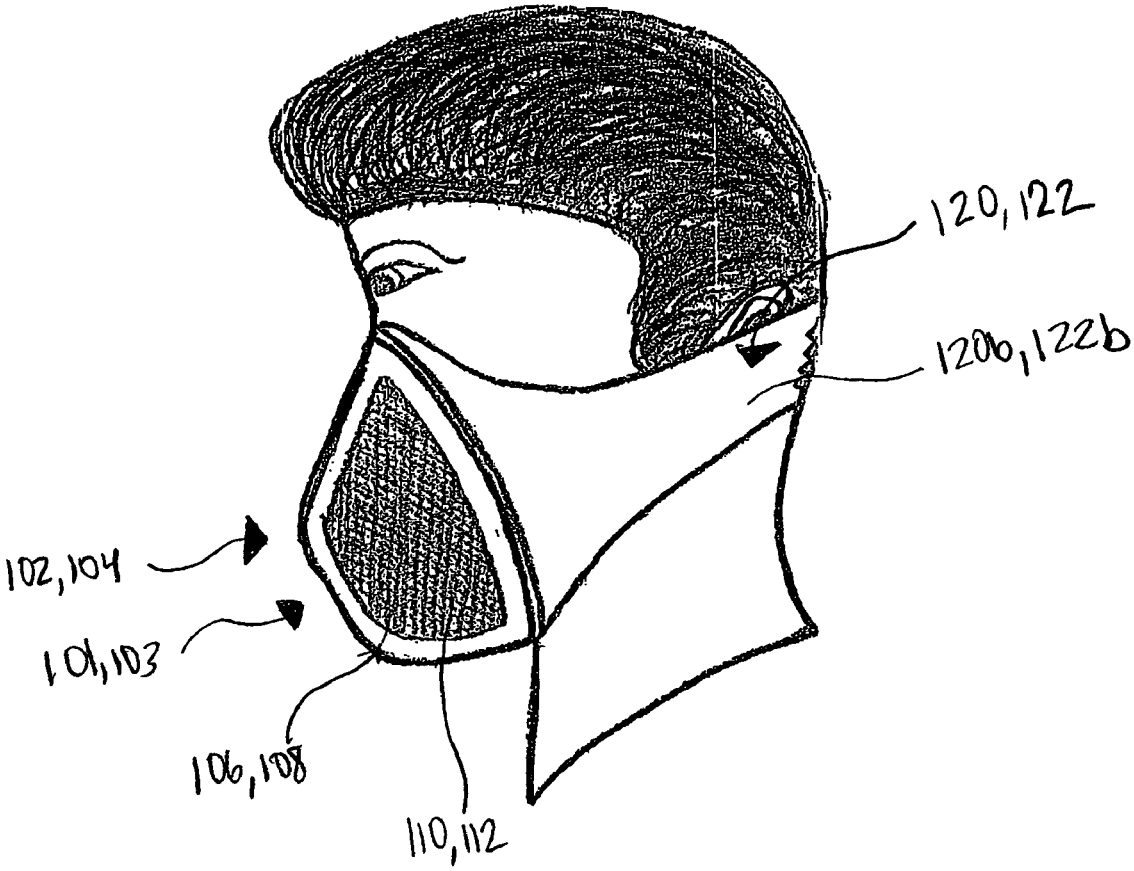
FIG. 5 is a side elevation view of the left chest garment region of FIG. 4 functioning as a facemask in one embodiment of the garment device of the present invention.
Figure 6:
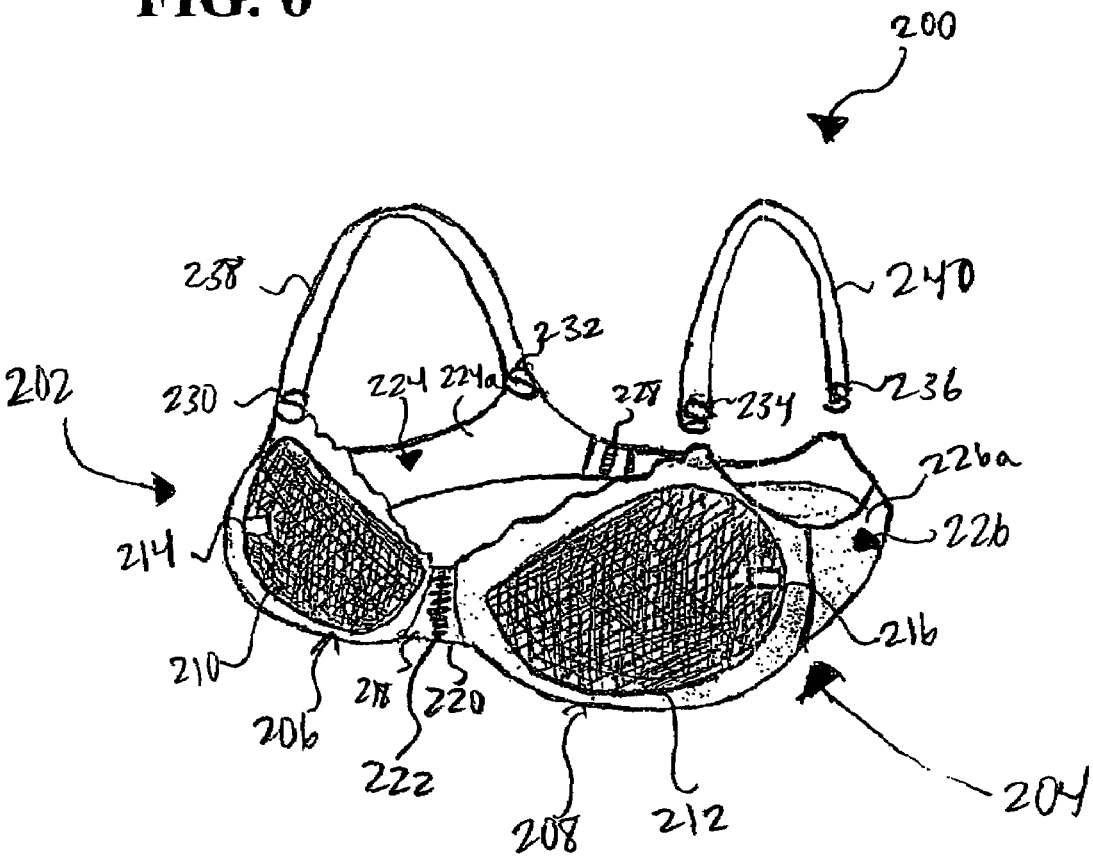
FIG. 6 is a front perspective view illustrating the breathe or exhalation valves and a detached shoulder strap of one embodiment of the garment device of the present invention.
Figure 7:
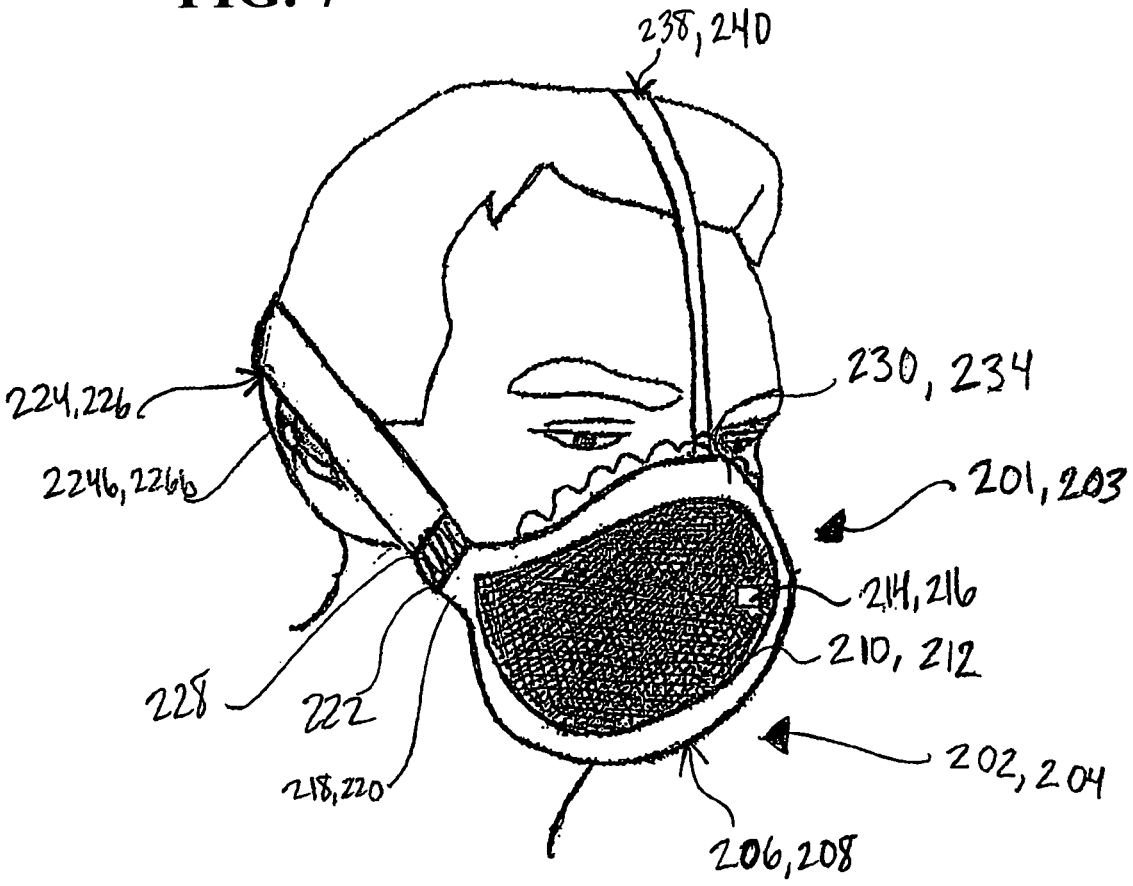
FIG. 7 is a front perspective view of the left chest garment region of FIG. 6 functioning as a facemask in one embodiment of the garment device of the present invention, the right chest garment region being a mirror-image thereof.

Referring now to the drawings, FIGS. 1, 2 and 3 illustrate one embodiment of the garment device 10 of the present invention. FIGS. 4 and 5 illustrate another embodiment of the garment device 100 of the present invention, and FIGS. 6 and 7 illustrate another embodiment of the garment device 200 of the present invention. It should be appreciated that, in other embodiments not illustrated, the garment device includes any suitable combination of the garment devices 10, 100 and 200 or any structural component thereof.

I. Garment Device with Fixed Shoulder Straps

In one embodiment, illustrated in FIGS. 1-3, the garment device 10 includes a plurality of detachable garment regions 12 and 14. The detachable garment regions 12 and 14 include: (a) a plurality of dome sections or cup sections 16 and 18, respectively, which, in one embodiment, are each of a suitable size to cover at least part of a chest area or breast, as well as at least a user's mouth and nose, though preferably the user's mouth-chin-nose region; (b) a plurality of filter devices 20 and 22, respectively, included in the cup sections 16 and 18, respectively, to filter the air inhaled by the user; (c) front-side connection regions 24 and 26, respectively, which secure the cup sections 16 and 18 together; (d) torso straps 30 and 32, respectively, extending from the cup sections 16 and 18, respectively, for securing the cup sections 16 and 18 to the user's body; and (e) backside connection regions 34 and 36, respectively, located on the torso strap ends 37 and 39, respectively, which secure the torso straps 30 and 32 to one another. In one embodiment, the garment device 10 includes a front-side securing device 28, such as a fastener, to facilitate attaching the front-side connection regions 24 and 26 together and detaching such regions. In one embodiment, the garment device 10 includes a backside securing device 38, such as a fastener, to facilitate detachably securing the backside connection regions 34 and 36 together.

A. Cup Sections

Each of the cup sections 16 and 18 may have any suitable size or shape to cover at least a portion of the user's face, preferably the chin-mouth-nose region. In one embodiment, the cup sections 16 and 18 each include breast cup sections 16 and 18 which define an area sized to at least partially cover the user's breast when the device 10 is used as a brassier or a bra. When the garment device 10 is used as facemasks 13 and 15, (as shown in FIG. 3) the same breast cup sections 16 and 18 are sized to cover the user's and another person's chin-mouth-nose area. In one embodiment, each cup section 16 and 18 is operable to cover the user's eyes. In one embodiment, the exterior or outer surfaces of the breast cup sections are substantially convex in shape. The cup sections 16 and 18 can be constructed of a flexible material. The material may include any suitable material, including, but not limited to, cotton, spandex, elastic, silk, polyester, foam, lycra, metal, lace, plastic or any suitable combination thereof. It should also be appreciated that the breast cup sections 16 and 18 may be constructed of filter cloth or fabric as described in more detail below. In one embodiment, the breast cup sections 16 and 18 each include one or more bra devices for providing support or comfort to the wearer, including, but not limited to, one or more wires, shaping inserts or pads or stiffening inserts. In one embodiment, the cup sections include adhesive edging or an aluminum molding strip on the outside of the cup. In one embodiment, each of the cups has a filter, an inner portion positionable adjacent to the inner area of the user's chest, and an outer portion positionable adjacent to the outer area of the user's chest. The inner portions of the cups are disconnectable, and the outer portions of the cups are disconnectable.

It should be understood that the cup sections can have any shape suitable for covering a portion of a breast, including, but not limited to, the shape of a cup. Therefore, each cup section can be a cup member, cup-shaped section or member, dome-shaped section or a member having a concave shape. In one embodiment, each cup section includes a cup member for a bra. The cup member includes a body sized to cover a portion of a breast. The cup member also includes a filter device and valve device, as such components are described below.

B. Filter Device

Each of the filter devices 20 and 22 may include or be constructed of any suitable filter or filtration material. The filter devices 20 and 22 may each have any suitable size to assist in protecting users against inhalation of harmful airborne particles or air contaminants, including but not limited to, radioactive particles, chemicals, harmful gasses, soot which may be produced following the collapse or the explosion of a building or fire, smoke, aerosols, microbials, or viruses. In one embodiment, each of the filter devices 20 and 22 includes a submicron filter covering the entire cup sections 16 and 18, respectively.

In one embodiment, each of the submicron filters has a plurality of pores having a diameter or size ranging from five one-hundredths of one micron to fifty microns. In one embodiment, the filter devices 20 and 22 filter out approximately ninety to ninety-five percent of particles that are greater than approximately one-half of one micron in size. In another embodiment, the filter devices 20 and 22 filter out approximately ninety to ninety-five percent or more of the particles that are equal to or greater than approximately one-tenth of one micron in size. In one embodiment, the filter devices 20 and 22 include High Efficiency Particulate Arrestance ("HEPA") filters. The filters 20 and 22 can assist in preventing the inhalation of airborne radioactive or infectious biological particles. In another embodiment, the filter devices 20 and 22 include any suitable filter that helps protect users against biological particle ionizing/nuclear radiation (such as BETA and Alfa), preferably shielding against X-ray and low energy gamma emissions. In one embodiment, the garment device 10 converts into two radiological masks 13 and 15, in which case, the filter devices 20 and 22 conform or substantially conform to the National Institute of Health center for disease controls regulations for radiological masks. It should be appreciated that the filter device 20 and 22 may each include any suitable filter to capture chemical air contamination or may include any particle filter, biological and/or radiological filter. The filter material 20 and 22, in one embodiment includes a chemical mechanism, an electric mechanism or electric-mechanical device to capture airborne particles, microbes and/or undesired gas. In an alternative embodiment, the filter devices 20 and 22, each include a mechanical component provided by a battery power source. The filter material may include any suitable material that enables or facilitates an adequate (and preferably continuous) circulation of breathable air for reducing harm to the user in air-contaminated environments.

It should be appreciated that the filters or filter devices 20 and 22 may each be a permanent part or a removable part of the garment device 10. In one embodiment, each of the filter devices 20 and 22 may take the form of or be housed in a lining pad to the cup portions 16 and 18 of the garment device 10. It should be appreciated that the filter devices 20 and 22, may be attached to the cup sections 16 and 18, respectively, in any suitable manner. The filter materials might be connected by a stitch, glued or snapped in to the cup region or section 16 and 18 of the garment device. The filter devices 20 and 22 can be disposable and replaceable, or the filter devices 20 and 22 can be removable and washable separate from the garment device 10. In one embodiment, the filter material is a permeable material which enables a person to breathe through the material. In one embodiment, the garment device 10 is completely constructed of the filter material. The entire cup sections 16 and 18 can be constructed of filter device or filter cloth.

When replaceable filter devices 20 and 22 are used, the replacement filters may be selected based, at least in part, on the particular application. The application may vary with the level of filter protection, type of air environment or air quality and the duration of use.

The filter devices or filter material 20 and 22 may be any color. In one embodiment, the garment device 10 includes a fabric dye providing the garment with a color such as blue red or green. Such coloring can help conceal the filters or indicate or conceal the used state of the filters.

In one embodiment, the filter devices 20 and 22 each include single or multiple layers of a suitable filter and/or single or multiple layers of a suitable fabric or cloth. The fabric or cloth used is preferably suitable for repeated cycles of washing and drying. In addition, each layer of filter, fabric or cloth can have a select pore size. Accordingly, the assembly of the layers of filter, fabric or cloth forms a filter having a designated filtering function. The filtering function can be varied by changing the number of layers used and/or the pore size of one or more of the layers. In one embodiment, the entire garment device 10 is constructed of such multiple layers of fabric or cloth. Here, the filter devices 20 and 22 are designated regions of such a multilayered garment device 10.

C. Front Connection Regions

In one embodiment, the front connection regions 24 and 26 are located on the interior base of each of the cup sections 16 and 18, respectively. In another embodiment, the front connection regions 24 and 26 extend from each of the cup sections 16 and 18, respectively. The connection regions 24 and 26 are suitable for attaching a securing device or a fastener 28 to enable the first connection regions 24 and 26 of each of the garment regions 12 and 14 to be attached together D. Front-Side Securing Devices Referring to FIGS. 1-3, in one embodiment, the front-side securing device 28 detachably connects the front connection regions 24 and 26 of the garment device 10 to one another. In one embodiment, the securing device 28 can include a fastener, such as breakable thread, that is operable to attach the cup sections 20 and 22 together but not re-attach the cup sections 20 and 22 together. In one embodiment, the securing device 28 is operable to detach and reattach the cup sections 16 and 18 together. Here, the securing device 28 can include a detachable or frontal fixed clasp used in a front opening bra. It should be appreciated, however, that the securing device 28 may be any suitable fastener or securing device, including, but not limited to, eye closures, slide fasteners, buttons, hook and loop fastener such as VELCRO.™., thread or other sewing material, hooks, loops, zippers and fixed or detachable clasp or modifications thereof. It should also be appreciated that the fasteners or the securing devices 28 of the garment device may be made of any suitable material.

E. Torso Strap and Backside Connection Region

With continued reference to FIGS. 1-3, in one embodiment, the torso straps 30 and 32 include: (a) first ends 31 and 33, respectively, each of which is attached to the cup sections 16 and 18, respectively; and (b) second ends 37 and 39, respectively, each of which is attached to a backside securing device or fastener 38. The torso straps 30 and 32 include torso engagement members 30*a* and 32*a*, respectively, when the garment device is used as a breast garment. These torso engagement members 30*a* and 32*a* function as head engagement members 30*b* and 32*b* when the garment device 10 is used as facemasks 13 and 15. When connected together, the torso straps 30 and 32 form a backside strap of a bra when the garment device 10 is being used as a bra garment. When the garment device 10 is converted into the facemasks 13 and 15, the torso straps 30 and 32 individually secure the cup sections 16 or 18, respectively, to the face of the user to produce or transform the garment into the facemasks 13 and 15. In this function, the torso straps 30 and 32 secure the cup sections 16 and 18, respectively, to the user's head, at least over the mouth and nose region of the user.

The torso straps 30 and 32 may be made out of any suitable material. This material may include, but is not limited to, cotton, spandex, silk, polyester, foam, lycra, metal, elastic, plastic or any combination thereof. It should also be appreciated that the torso straps may be adjustable and made of any suitable length and any suitable width.

In one embodiment, the torso straps 30 and 32 include backside connection regions 34 and 36, respectively. The connection regions 34 and 36 are operable to attach the straps 30 and 32 to one another. In addition, the backside connection regions 34 and 36 are operable to attach to the front connection regions 24 and 26, respectively. In one embodiment, the device 10 includes a backside fastener 38 coupled to the connection regions 34 and 36. This fastener 38 facilitates the removable connection of the regions 34 and 36. The fastener 38 may include any suitable type of fastener or connector with mating members.

F. Shoulder Straps

In one bra embodiment of the garment device, the shoulder straps or arms 40 and 42 provide support for the breasts. In particular, the arms 40 and 42 transfer the weight of the breasts to the user's shoulders. The arms 40 and 42 can include adjustable members to secure the arms tightly around the user's shoulders and back. The arms may be made of any suitable material and may have any suitable length and width. In one embodiment, the straps are made of an anti-slipping material to further secure the bra to the person's shoulders.

G. Method of Conversion of the Garment Device to Facemasks

The garment device 10 of the present invention is convertible from a garment device 10 into multiple facemasks 13 and 15, each of which is illustrated in FIG. 3. In one embodiment, the garment device 10 is a brassier or bra which includes two separate cup regions 16 and 18 as described above. When the air becomes contaminated, the wearer of the bra manipulates the front-side fastening member 28 and the backside fastening member 38 to separate the two regions 12 and 14 and remove such regions 12 and 14 from her upper body. The garment regions 12 and 14 include filter devices 20 and 22, respectively. To form a facemask 13, for example, the user wraps the applicable torso strap 30 and 30*b* around the head to secure the cup section 16 to the face of the user. The facemask 13 then covers the chin, mouth and nose area of the face as illustrated in FIG. 3. The strap 30 is secured to the connection region 24 of the cup section 16 to tighten and secure the cup section 16 to the face. The user places the strap 40 over the nose and forehead region to further secure the mask to the head. The securing device or fastener 28 is operable to be secured to the second securing device or fastener 38. Because the garment device 10 is convertible into a plurality of facemasks, the user may wear one of the facemasks and provide the other facemask to a bystander.

II. Garment Device with Removable Shoulder Straps

As illustrated in FIGS. 4 and 5, in another embodiment, the garment device 100 includes a plurality of detachable garment regions 102 and 104. The garment regions 102 and 104 include: (a) a plurality of cup sections 106 and 108, respectively, which, in one embodiment, are each of a suitable size to cover at least part of a chest area or breast, as well as at least the user's mouth and nose, though preferably the user's chin-mouth-nose region; (b) a plurality of filter devices 110 and 112, respectively, included in the cup sections 106 and 108, respectively, to filter the air inhaled by the user; (c) a plurality of front connection regions 114 and 116, respectively; (d) a plurality of torso straps 120 and 122, respectively, extending from the cup sections 106 and 108, respectively, for securing the garment device 100 to the body; and (e) a backside connection region (not illustrated) which is operable to connect the torso straps 120 and 122 together. The torso straps 120 and 122 include torso engagement members 120*a* and 122*a*, respectively, when the garment device is used as a breast garment, and these torso engagement members 120*a* and 122*a* function as head engagement members 120*b* and 122*b* when the garment device 10 is used as facemasks 101 and 103. The foregoing components of garment device 100 are similar to those described above with respect to garment device 10. The garment device 100 also includes a front-side securing device 118 for detachably connecting the front connection regions 114 and 116 of the cup sections 106 and 108 together. The garment device 100 has the components and methods similar to all of the components and materials of garment device 10, except that the shoulder straps of garment device 100 are detachable.

In one embodiment, the shoulder straps 124 and 126 are attached to the cup sections 106 and 108, respectively, using detachable connectors, securing devices or fasteners 128 and 130, respectively. Likewise, the straps 124 and 126 are attached to the torso straps 120 and 122, respectively, by a fastener (not shown) and fastener 132, respectively. These fasteners enable each of the shoulder straps to be unattached from the garment device 100, preferably in a quick-release fashion.

In operation, as illustrated in FIG. 5, the user can remove the shoulder straps 124 and 126 before converting the garment device 100 to a facemask 101 or 103. As such, less of the user's head and hair will be disturbed or otherwise engaged by the facemask. Also, the facemasks 101 and 103 will be relatively light-weight due to the removal of the shoulder straps 124 and 126.

III. Garment Device with an Exhalation Valve

As illustrated in FIG. 6 and FIG. 7, in one embodiment, the garment device 200 includes a plurality of detachable garment regions 202 and 204. The detachable regions 202 and 204 include: (a) a plurality of cup sections, 206 and 208 respectively, which, in one embodiment, are each of a suitable size to cover at least part of a chest area or breast, as well as at least a user's nose and mouth, and preferably a user's chin-mouth-nose region; (b) a plurality of filter devices 210 and 212, respectively, included in the cup sections 206 and 208, respectively, to filter the air inhaled by the user; (c) a plurality of front connection regions 218 and 220, respectively, which secure the cup sections 206 and 208 together; and (d) a plurality of torso straps 224 and 226, respectively, extending from the cup sections 206 and 208, respectively, which secure the cup sections to a user's torso. The illustrated embodiment includes a plurality of arms or shoulder straps 238 and 240 for securing the garment device 200 to the user's shoulders. Also, the garment device 200 includes fasteners or connectors 230, 232, 234 and 236 which enable the user to detach the shoulder straps 238 and 240 from the garment device 200. As illustrated in FIG. 6, a shoulder strap 238 may remain connected to the garment device when used as a bra garment 200 or a facemask 201 and 203. A shoulder strap 240 may also be detached, as illustrated in FIG. 6, when the garment is worn as a bra garment or a facemask. It should be appreciated, in an alternate embodiment, the garment device 200 of the present invention may include fixed shoulder straps, detachable shoulder straps or no shoulder straps at all. The garment device 200 has the components and materials similar to those components and materials described above with respect to garment devices 10 and/or 100, except that garment device 200 includes a plurality of exhalation valves 214 and 216.

When the garment device 200 is used as facemasks 201 and 203, the exhalation valves 214 and 216 increase the rate at which the user can exhale air. In one embodiment, the exhalation valves 214 and 216 are each a one-way valve. When the user inhales, each one-way valve 214 and 216 is closed to reduce or minimize the inhalation of contaminated air. When the user exhales, each one-way valve 214 and 216 opens and enables the user to exhale exhausted air which is expelled from the mask cavity. In one embodiment, the exhale valve 214 and 216 facilitates normal breathing for greater than approximately fifteen minutes.

The exhale valves 214 and 216 may be located in any suitable position of the garment device 200. Suitable positions may include, but are not limited to, the center of the cup sections 206 and 208, the center of the filter devices 210 and 212, the outside edges of the cup sections 206 and 208 or the outer edges of the filter devices 210 and 212. In one embodiment, the exhale valves 214 to 216 are relatively small valves embedded or encased in the fabric of the cup sections 206 and 208 or in the filter devices 210 and 212. In another embodiment, the exhale valves 214 and 216 are located on the torso straps 224 and 226 or the shoulder straps 238 and 240. In one embodiment, the user inhales air through a filter device 210 and 212 which includes a permeable filter and exhales through the exhale valve 214 and 216 so the user does not have to inhale contaminated air.

It should be appreciated that the garment device of the present invention may be any suitable garment or wearable item, including, but not limited to, a bra or brassiere, slip, cap, hat, head cover, scarf, shirt, nightgown, undershirt or any other type of undergarment, a glove, a mitten or other clothing. Depending upon the embodiment, the facemask of the present invention may cover only the mouth, only the nose, the mouth and the nose, or any of such body parts in conjunction with the chin, eyes or other body parts. In one embodiment, the garment device includes: (a) a main portion or garment body adapted to engage, cover or otherwise interact with one or more of the user's body parts; (b) a filter device attached to the garment body; and (c) a valve device attached to the garment body.

In one embodiment, the garment device of the present invention includes ear loops. When the garment is a mask, the ear loops enable a user to secure the mask to his or her face by putting the loops around his or her ears. In another embodiment, the garment device includes self-adjusting elastic bands to secure the mask to the user's face. In one embodiment, the garment device includes one or more inhalation air valves. These inhalation valves are positionable adjacent to the user's mouth and/or nose when the garment device is converted to a facemask.

The garment device of the present invention, in one embodiment, includes a fully-separable bra. The front midsection and back midsection of the bra are separable. Each cup of the bra includes an air filter. When the air becomes contaminated due to an act of warfare, terror or other event, the user can remove the bra and detach the cups forming two facemasks. The user then, in this example, secures the facemask to her face and can provide the other facemask to a bystander. This type of garment device increases the safety of civilians and non-civilians in the event of air contamination.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A bra garment comprising:

a plurality of detachable cup sections, each of the cup sections having: (a) a filter device; (b) a first portion positionable adjacent to a first central area of a user's chest; (c) a second portion positionable adjacent to a second outer area of the user's chest adjacent to an underarm; and (d) a valve device;

at least one securing device detachably coupling the first portions of the cup sections to one another; and at least one other securing device attached to the second portion of at least one of the cup sections, said other securing device operable to: (a) detachably couple the second portions of the cup sections to one another; and (b) for each one of the cup sections, attach the second portion of said cup section to the first portion of said cup section after said cup section is detached from the other cup section.

2. The bra garment of claim 1, wherein each of the filter devices includes at least one of a submicron filter or a plurality of layers of filters.

3. The bra garment of claim 1, wherein each of the filter devices includes at least one of: (a) a single layer of cloth or fabric; or (b) a plurality of layers of cloth or fabric.

4. The bra garment of claim 1, which includes a plurality of detachable shoulder straps, each one of the detachable shoulder straps being connectable to one of the cup sections and to a torso strap.

5. The bra garment of claim 4, wherein the torso strap includes a first end and a second end, the first end connectable to one of the detachable cup sections and the second end detachably connectable to a second end of another torso strap.

6. A garment device convertible from a breast garment to at least one facemask, the garment device comprising:

a plurality of detachable garment regions, each of the garment regions having:

(a) a breast cup section defining an area sized to at least partially cover a breast of a user and a mouth-nose region of the user;

(b) a breast cup connector including a first end and a second end, the first end connectable to one of the breast cup sections and the second end connectable to another one of the breast cup sections;

(c) a torso strap including a first end and a second end, the first end of the torso strap being connectable to the breast cup section of one of the garment regions, the second end of the torso strap being detachably connectable to the second end of the torso strap of another one of the garment regions, each of the torso straps being configured to interchangeably secure one of the garment regions:

(i) to a torso of the user when said torso strap is engaged with the torso of the user; and (ii) to a head of the user when said torso strap is disengaged from the torso and engaged with the head of the user;

(d) a filter device attached to one of the breast cup sections; and (e) an exhalation valve device attached to one of the breast cup sections.

7. The garment device of claim 6, which includes at least one first fastener attached to the second end of at least one of the breast cup section connectors, the first fastener operable to enable the user to: (a) attach the breast cup section connectors to one another; and (b) detach the breast cup section connectors from one another.

8. The garment device of claim 6, which includes at least one second fastener attached to the second end of at least one of the torso straps so that, for each one of the garment regions, the second fastener is operable to enable the user to attach the torso strap of said garment region to the breast cup section connector of said garment region after said garment region is detached from the other garment region.

9. The garment device of claim 6, wherein each of the filter devices includes at least one of a submicron filter or a plurality of layers of filters.

10. The bra garment of claim 6, wherein each of the filter devices includes at least one of: (a) a single layer of cloth or fabric; or (b) a plurality of layers of cloth or fabric.

11. The garment device of claim 6, which includes a plurality of detachable shoulder straps coupled to the detachable garment regions.

12. A method for manufacturing a garment device convertible from a breast garment to a plurality of facemasks, the method comprising:

(a) assembling a plurality of detachable garment regions, said assembling step, for each of the garment regions, including:

(i) assembling a breast cup section defining an area sized to at least partially cover a breast of a user and a mouth-nose region of the user;

(ii) attaching an air filter device to one of the breast cup sections;

(iii) providing an elongated securing member having a first end and a second end; and (iv) attaching the first end of one of the elongated securing members to a portion of one of the breast cup sections;

(b) constructing the breast cup sections in a fashion so that each one of the breast cup sections is detachable from another one of the breast cup sections; and (c) constructing the second ends of the elongated securing members in such a fashion that; (i) the second ends are detachably connectable to one another; and (ii) the second end of each one of the breast cup sections is detachably connectable to another portion of said breast cup section when the breast cup sections are detached from one another.

13. The method of claim 12, wherein each of the filter devices includes at least one of a submicron filter or a plurality of layers of filters.

14. The method of claim 12, wherein each of the filter devices includes at least one of: (a) a single layer of cloth or fabric; or (b) a plurality of layers of cloth or fabric.

15. The method of claim 12, which includes attaching a plurality of shoulder straps to the breast cup sections.

16. The method of claim 12, which includes attaching an exhalation valve device to each of the breast cup sections.

17. A cup member for a bra of a user, the user having at least one breast, the cup member comprising:

a body having a region sized to cover a portion of the breast, the body having:

(a) a first portion positionable adjacent to a central chest area of the user, and (b) a second portion, the first portion and the second portion being separated by the region;

a filter device attached to the body;

a valve device attached to the body; and at least one strap having an end connected to the second portion and another end detachably connectable to the first portion.

18. The cup member of claim 17, wherein the filter device includes at least one of submicron filter or a plurality of layers of filters.

19. The cup member of claim 17, wherein the filter device includes at least one of: (a) a single layer of cloth or fabric; or (b) a plurality of layers of cloth or fabric.

20. The cup member of claim 17, which includes a securing member which detachably attaches the cup member to the bra.

21. A bra device for a user having at least one breast, the bra device being convertible to a facemask, the bra device comprising:

a garment body having a region sized to cover a portion of the breast, the garment body having:

(a) a first portion positionable adjacent to a central chest area of the user, and (b) a second portion, the first portion and the second portion being separated by the region;

a filter device attached to the garment body;

a valve device attached to the garment body; and at least one strap having an end connected to the second portion and another end detachably connectable to the first portion.

22. The bra device of claim 21, wherein the filter device includes at least one of a submicron filter or a plurality of layers of filters.

23. The bra device of claim 21, wherein the filter device includes at least one of: (a) a single layer of cloth or fabric; or (b) a plurality of layers of cloth or fabric.

24. A bra device for a user having at least one breast, the bra device being convertible to a facemask, the bra device comprising:

a garment body;

at least one garment region detachably connected to the garment body, the garment region having:

(a) a cup-shaped section defining an area sized to at least partially cover the breast of the user and a mouth-nose region of the user, the cup-shaped section having:

(i) a first portion positionable adjacent to a central chest area of the user, and (ii) a second portion, the first portion and the second portion being separated by the area;

(b) a filter device attached to the cup-shaped section;

(c) an exhalation valve attached to the cup-shaped section; and (d) at least one strap having an end connected to the second portion and another end detachably connectable to the first portion.

25. The bra device of claim 24, wherein the filter device includes at least one of a submicron filter or a plurality of layers of filters.

26. The bra device of claim 24, wherein the filter device includes at least one of: (a) a single layer of cloth or fabric; or (b) a plurality of layers of cloth or fabric.

* * * * *